United States Patent [19]

Carter

[11] 4,020,963

[45] May 3, 1977

[54] LINKAGE MEANS FOR BUCKET POSITIONER SYSTEM

[75] Inventor: Carl W. Carter, Peoria County, Ill.

[73] Assignee: Caterpillar Tractor Co., Peoria, Ill.

[22] Filed: June 18, 1976

[21] Appl. No.: 697,504

[52] U.S. Cl. ..... 214/762; 74/519

[51] Int. Cl.[2] ..... E02F 3/85

[58] Field of Search ..... 214/140, 762, 764; 74/516, 519, 522.5; 91/358 A

[56] References Cited

UNITED STATES PATENTS

| | | | |
|---|---|---|---|
| 3,429,471 | 2/1969 | Austin et al. | 214/762 |
| 3,836,032 | 9/1974 | Geier | 214/764 |

*Primary Examiner*—L. J. Paperner

*Attorney, Agent, or Firm*—Phillips, Moore, Weissenberger, Lempio & Majestic

[57] ABSTRACT

A loader comprises a pair of lift arms pivotally mounted on a frame, and a bucket pivotally mounted on the forward end of the lift arms. A bucket tilt linkage, including at least one double-acting hydraulic tilt cylinder is operatively connected between the lift arms and the bucket to selectively position the bucket for various earth-working operations. The tilt linkage further includes improved linkage means for mechanically coupling sensed positions of an extensible rod of the cylinder across the pivot axis of the cylinder for enabling control means to respond to this condition independently of cylinder angular position.

13 Claims, 5 Drawing Figures

LINKAGE MEANS FOR BUCKET POSITIONER SYSTEM

BACKGROUND OF THE INVENTION

Conventional loader vehicles are adapted to perform various digging, loading and carrying functions during a cycle of loader operation. During certain phases of the loading operation, such as rack-back of the bucket after it has been loaded, it is desirable to provide means to continue the rack-back action, once such action is initiated by the operator, and to stop such action automatically when the bucket arrives at a predetermined position. Such automatic operations are generated typically by devices called, respectively, detent means and detent release means. They allow an operator to be free to direct his attention elsewhere, as needed. Release means have included various cable coupling schemes for transferring a detected degree of extension of a tilt cylinder rod to the detent release control means. Such coupling structures generally include flexible control cables that couple, either hydraulically or mechanically, the control signals to the detent release control means. Flexibility is required because the tilt cylinder pivots with respect to the loader vehicle operator controls.

Of general interest are U.S. Pat. No. 3,836,032, and patent application Ser. No. 586,846.

SUMMARY OF THE INVENTION

The invention comprises an improved linkage means for coupling a mechanical signal, activated by a sensed position of a tilt cylinder rod, across the pivot axis of the cylinder to control means for actuation of detent release means.

An object of this invention is to provide a linkage means that will sense a given length of a telescoping tilt cylinder which is also pivotally attached to the vehicle at a pivot axis wherein the linkage will transfer a mechanical signal base on this sensed link across the pivot axis of the tilt cylinder within the limits of the operative pivot angle of the tilt cylinder, regardless of cylinder angular attitude.

Broadly stated, the invention comprises a linkage means that is operatively coupled to first and second members that are pivotally mounted relative to each other about a pivot axis. The linkage means selectively transmits a mechanical signal across this pivot axis. The linkage means comprises a first link that is pivotally mounted to the first member to be pivotal to first and second positions relative thereto. The first link also defines a circular cam surface thereon. A second link is pivotally mounted to the second member to be pivotal to first and second positions relative thereto. This second link defines a coacting surface which said circular cam surface contacts when the first link is in the first position thereof, to define a first position of the second link. Also included are means for moving the second link to a second position responsive to movement of the first link to its second position. The invention further comprises mechanical signal originating means that are operatively coupled to the first link. This originating means selectively moves the first link to respective first and second positions. Mechanical signal receiving means are also included that are operatively coupled to the second link to be moved upon the movement of the second link to its first and second positions thereof responsive to movement of said first link to its first and second position thereof. Finally, the centerpoint of the circular cam surface is positioned to lie substantially along, i.e. concentric with, the pivot axis of the first and second members, when the first link is in its first position and when the circular cam surface thereby is in contact with the coacting surface of the second link. This is so that, during the pivoting of the first member relative to the second member with the first link in its first position, the second link remains stationary, relative to the second member.

BRIEF DESCRIPTION OF THE DRAWINGS

Other objects of this invention will become apparent from the following description and accompanying drawings, wherein.

DETAILED DESCRIPTION OF THE PREFERRED EMBODIMENT

Figure 1:
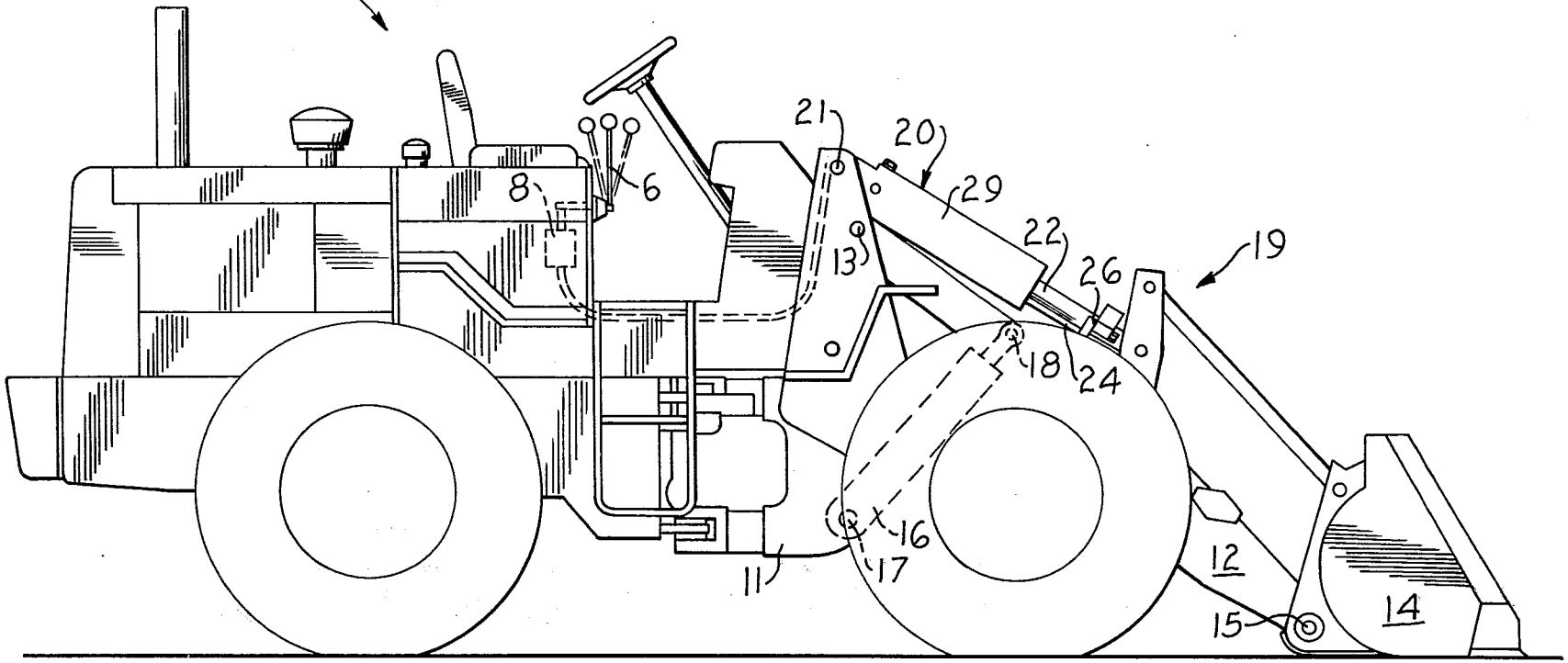
FIG. 1 is a side elevational view of a loader vehicle, employing the detent release means of this invention thereon.

FIG. 1 illustrates a loader vehicle 10 comprising a frame 11 having a pair of lift arms 12 (one shown), each pivotally mounted thereon by a pivot pin 13. The lift arms have a bucket 14 pivotally mounted on the forward ends thereof by laterally-spaced pivot pins 15 (one shown). Although the hereinafter-described positioner finds particular application to such a loader bucket, it should be understood that this invention may be adapted for use in linkage systems for all types of machines.

Each lift arm 12 is adapted to be selectively raised or lowered by a double-acting hydraulic cylinder 16 pivotally mounted on frame 11 and the lift arm by pivot pins 17, 18, respectively. A standard tilt linkage or bucket positioner means 19 is pivotally interconnected between the lift arms and the bucket to move it between its full and dotted line positions, as shown in FIG. 1. The tilt linkage includes a hydraulically actuated double-acting cylinder 20, pivotally mounted on the frame 11 by a pivot pin 21.

Cylinder 20 has a rod 22 reciprocally mounted therein to be selectively extended or retracted thereby. In the present embodiment, the extension of the tilt cylinder 20, rod 22 causes the bucket 14 to tilt forward into a "dump" attitude. Retraction of the rod 22 into the cylinder 20 causes the bucket 14 to tilt back in a rearward direction toward the vehicle 10. This attitude of the bucket 14 is termed "rack-back".

A typical operator control for actuating the cylinder 20 and thus controlling the position of the bucket 14 is a hand lever 6 connected to a hydraulic valve 8. The valve 8 is typically of a spool type, spring centered to a neutral position (N) between the dump (D) and rack-back (R) command positions, with a detent and detent-release mechanism at the R position. Thus, when the operator moves lever 6 toward the D position, the bucket 14 is caused by the tilt linkage means 19, including the tilt cylinder 20, to rotate forward until the operator releases lever 6, allowing the lever to spring return to its N position, or until the maximum dump angle of the bucket is reached. When the operator moves lever 6 toward the R position, one of two results is possible. If the lever 6 is not moved completely back into the R command position, the rearward rotation of the bucket 14 will stop when the operator releases the lever 6 and allows the valve 8 to return to its N position. If the lever 6 is moved back fully to the R command position, the detent engages to hold the valve 8 at that position, to thereby enable the bucket 14 to automatically continue to rotate in a rearward direction, or rack-back, without need for the operator to continue holding lever 6 in the R position. The bucket 14 will continue to rotate back until a detent release signal is detected by the valve 8, at which time the rack-back is automatically stopped. The detent release signal is usually produced by the automatic detection of a given retraction (or extension, if desired) of rod 22 in the tilt cylinder 20.

Note that the rod 22 need not be fully retracted before the detent release signal is generated. Retraction of the bucket 14, beyond the point when a detent release signal is generated, is useful under the manual control of lever 6 only, since the bucket 14 in such a mode could be used to pry loose material being excavated, for example, without the actuation of the detent means. This is because such excavation requires successive rack-back commands. It would be inefficient to constantly require the operator to release the detent means when the detent means can be kept off by the detent release signal.

Figure 2:
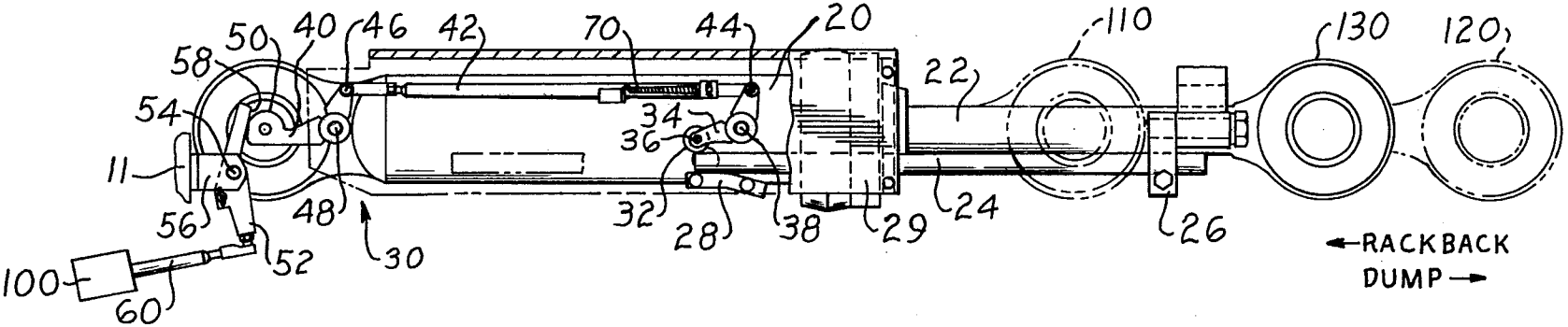
FIG. 2 is an enlarged side view of the tilt cylinder with linkage means installed thereon.
Figure 3:
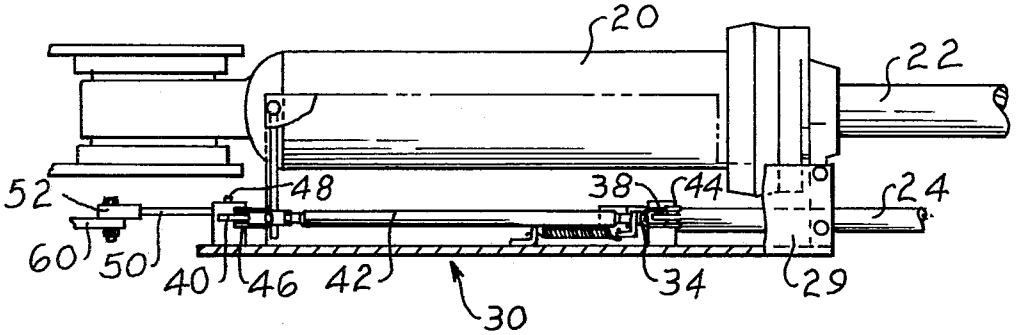
FIG. 3 is the top view of the tilt cylinder and linkage means of FIG. 2.
Figure 4:
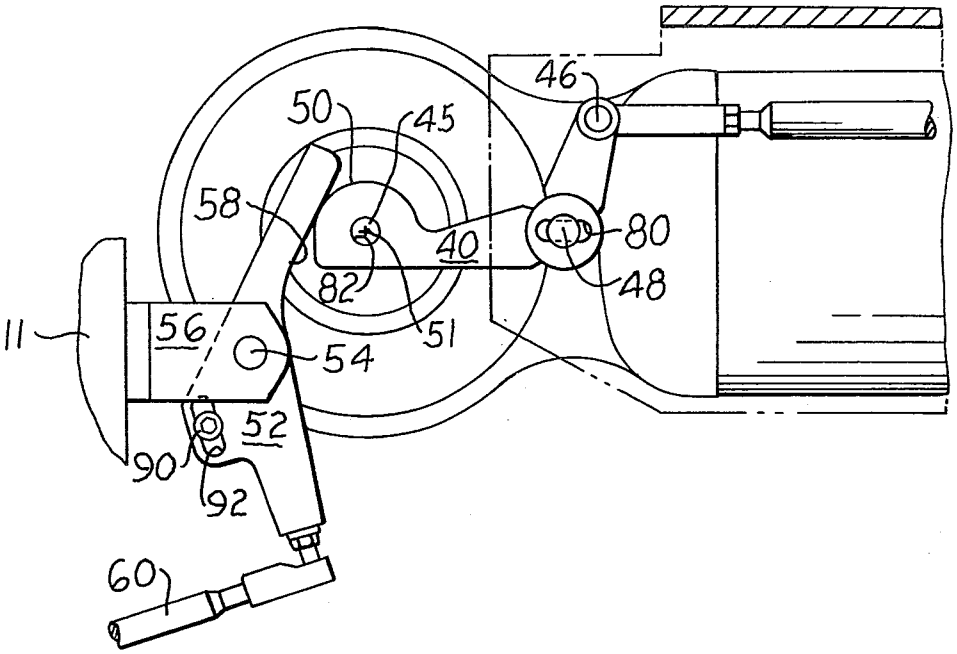
FIG. 4 is a further enlarged view of the tilt cylinder and linkage means detailing the linkage structure at the pivot axis of the tilt cylinder.

The present invention, as shown in FIGS. 2, 3 and 4 involves an improvement in the linkage means 30 used for coupling a detected position of the rod 22 of the tilt cylinder 20 across the pivot axis of the tilt cylinder 20 to the detent release control means 100 and thereby to the valve 8. A plate 29, shown partially cut-away in FIG. 2, acts as mounting means and as a protective plate for most of the linkage means 30. For generating the detent release signal, a rod or slide bar 24 is secured to the piston rod 22 by a bracket 26, and is slidably mounted parallel to said rod 22 but external to the cylinder 20. The slide bar 24 is guided against a roller 32, when said bar 24 is retracted beyond a certain point, by a guide bracket 28. The roller 32 is rotatably mounted on an arm of a link 34, shaped in the form of a bifurcated bracket or bell crank, by a pin 36. The bell crank 34 is pivotally mounted on the plate 29 by a pivot pin 38. Note that bell crank 34 acts as the sensing link by changing its position during the time that the roller 32 rides on the bar 24. The bell crank 34 is operatively connected to a bell crank-shaped link 40 by means of a connecting rod 42. The connecting rod 42 is connected by a pin 44 to the arm of the bell crank 34 opposite from the arm having the roller 32 mounted thereon, and by a pin 46 to the bell crank 40.

The bell crank 40 is pivotally mounted to the plate 29 by pivot pin 48. A circular cam surface 50 is defined on the arm opposite the arm to which the connecting rod 42 is mounted. As shown more clearly in FIG. 4, the bell crank 40 is operatively positioned such that, when the linkage means 30 is in an actuated state, as shown, the centerpoint 51 of the cam surface 50, i.e. the radial center of the circular planes of the surface 50, is concentric to the pivot axis 45 of the tilt cylinder 20. A bell crank-shaped link 52 is pivotally mounted on the vehicle frame 11 by means of a pivot pin 54 and bracket 56. As shown in FIG. 4, bell crank 52 is positioned so that the surface 58 of one arm of said bell crank 52 rides on the cam surface 50 of the bell crank 40 when the linkage means 30 is actuated. The other arm of the bell crank 52 has a connecting rod 60 attached to it. This connecting rod 60 couples movement of the bell crank 52 to detent release control means 100, as indicated in FIG. 2.

In operation, the rod 22 of the tilt cylinder 20 is movable to any position between the two dotted-line positions 110, 120, shown in FIG. 2. Between positions 120 and 130, as rod 22 is retracted, the detent means is allowed to operate, to enable automatic rack-back of bucket 14, as explained above. When position 130 is reached, the linkage means 30 is actuated to couple a positive mechanical signal across the pivot axis 45 of the tilt cylinder 20. In other words, the contacting of roller 32 with rod 24 constitutes the actuation of the linkage means 30. Specifically, with the roller 32 riding on the slide bar 24, the cam surface 50 acts to allow the bell crank 52 to remain stationary, regardless of the angular attitude of the tilt cylinder 20, with respect to the vehicle frame 11. This result occurs since, in the actuated state, the centerpoint axis 51 of the circular cam surface 50 coincides with the pivot axis 45 of the tilt cylinder 20 as the cylinder 20 is pivoted. Thus, the circular cam surface 50 pivots about the pivot axis 45 of the tilt cylinder such that the radial distance from the pivot axis 45 to the cam surface 50, and thus the distance of the bell crank 52 to the pivot axis 45, is always constant. Thus, the linkage means 30 is operatively unaffected by the angular position of the tilt cylinder 20. Thus, the linkage means 30 operates to transfer a detected degree of retraction of the tilt cylinder rod 22 across the pivot axis 45 of the tilt cylinder 20 to control means, which, in the present embodiment, include detent release control means 100. This detent release control means 100 stops the automatic retraction of the rod 22 which, in the preferred embodiment, thereby stops the rack-back of the bucket 14 at the desired point.

When rod 22 is moved out of its rack-back position, the linkage means 30 becomes unactuated when the slide bar 24 extends out from the cylinder 20 sufficiently far to cause roller 32 to lose contact with the slide bar 24, i.e. after position 130 is passed. With reference to FIG. 2, it is seen that the bell crank 34 is biased to rotate about its pivot pin 38 by a spring 70, so that when the roller 32 loses contact with the slide bar 24, the spring 70 causes the bell crank 34 and roller 32 to move to the dotted-line position shown. This movement is coupled by connecting rod 42 to bell crank 40. Bell crank 40 is caused thereby to pivot about its pivot pin 48, which results in movement of the circular cam surface 50 relative to the pivot axis 45 of cylinder 20. Again, the operation of this linkage means 30 is unaffected by the angular disposition of the tilt cylinder 20 with respect to vehicle frame 11. Lastly, the movement of the bell crank 52 is transmitted, as described above, by connecting rod 60 to the detent release control means 100, which becomes disabled thereby.

Referring to FIG. 4, a means for precisely adjusting the cam surface 50 relative to the pivot axis 45 includes a slot 80 formed in the bell crank 40 at the point where bell crank 40 is connected by pivot pin 48 to plate 29. The slot 80 allows the bell crank 40 and thus the cam surface 50 to be positioned optimally relative to the pivot axis 45. A hole 82 in the bell crank 40 at the centerline of the circular cam surface 50 would allow for easier visual (or mechanically with assembly pin) alignment of this surface 50 with respect to the pivot axis 45. Note that connecting rod 42 is not a limiting factor in the positioning of bell crank 40 since the rod 42 is of a standard type that is adjustable in length.

Referring again to FIG. 4, an adjustable stop means 90 may be provided, if needed, to keep bell crank 52 from riding on the cam surface 50 too far away from its actuated position. The stop means 90 would be adjustable within a slot 92 formed in bell crank 52. Since the bell crank pivots about pivot pin 54 when the linkage means 30 is actuated, the stop means 90 would limit this rotational movement of bell crank 52, since angular rotation causes the stop means 90 to abut bracket 56 after a given distance has been travelled. Such a structure may be required to protect the control means 100, attached to bell crank 52 by connecting rod 60, from being damaged due to excessive over-travel of the connecting rod 60.

Figure 5:
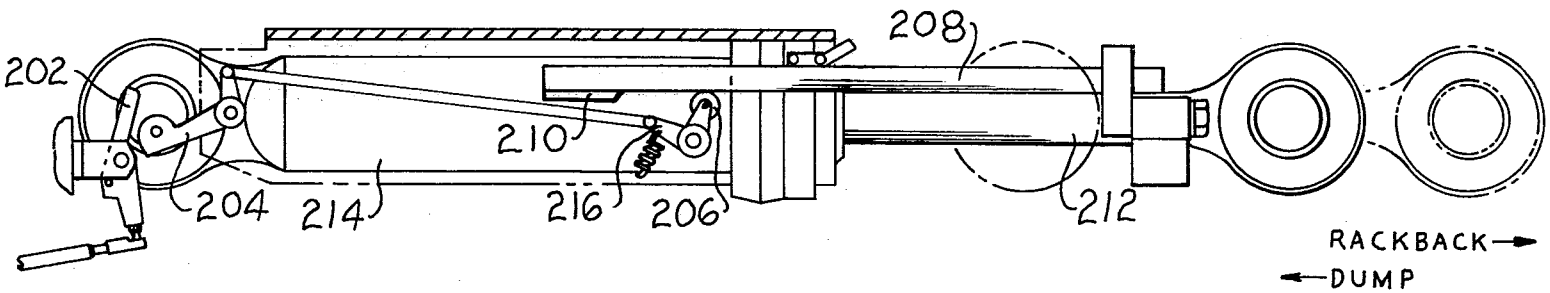
FIG. 5 illustrates a second embodiment of linkage means installed on a tilt cylinder.

FIG. 5 illustrates an alternate linkage means embodiment wherein the extension of a tilt cylinder rod creates the mechanical signal that is coupled across the pivot axis 45 of the tilt cylinder. In this embodiment, the pivot axis linkage elements 202 and 204 are the same as in the prior embodiment. The difference is that roller 206 continuously rides on the rod or slide bar 208. The linkage actuation occurs when the roller 206 contacts the surface 210 of rod 208 to thereby move the sensing link 216 from an unactuated position to an actuated position. As can be seen, this occurs as the rod 212 of the tilt cylinder 214 is extended in an outward direction from the tilt cylinder 214. Thus, the sensing linkage used to couple a mechanical signal up to the cam link 40 (or 204), the link that is positioned relative to the pivot axis 45, can be implemented in a number of ways.

What is claimed is:

1. Linkage means operatively coupled with first and second members pivotally mounted relative to each other about a pivot axis, for selectively transmitting a mechanical signal across said pivot axis comprising;

a first link pivotally mounted to the first member to be pivotable to first and second positions relative thereto, and defining a circular cam surface;

a second link pivotally mounted to said second member to be pivotable to first and second positions relative thereto, and defining a coacting surface which said circular cam surface contacts with the first link in said first position thereof, to define a first position of the second link;

means for moving the second link to a second position responsive to movement of the first link to its second position;

mechanical signal originating means operatively coupled to said first link to selectively move said first link to respective first and second positions;

mechanical signal receiving means operatively coupled to said second link to be moved upon movement of said second link to said first and second positions thereof responsive to movement of said first link to said respective first and second positions thereof; and wherein the centerpoint of the circular cam surface lies substantially along the pivot axis of the first and second members with the first link in said first position and with the circular cam surface in contact with said coacting surface of the second link, so that during pivoting of the first member relative to the second member with the first link in said first position, the second link remains stationary relative to the second member.

2. The linkage means of claim 1 wherein said mechanical signal originating means comprises linkage actuation means comprising:

a sensing link pivotally mounted to said first member;

a connecting rod for operatively connecting said sensing link to said first link;

a roller rotatably mounted to said sensing link;

a slide bar reciprocally mounted to said first member in a position such that said roller may ride thereon;

biasing means for retaining said sensing link in a first position against said slide bar when said roller is riding on said slide bar, and wherein said biasing means biases said sensing link to a second position when said roller is not rotatably riding on said slide bar; and means for operatively moving said slide bar relative to said sensing link and said roller, to enable thereby linkage actuation to occur when said slide bar is moved to the position wherein the roller rides thereon, said sensing link being positioned thereby in said first position.

3. The linkage means of claim 2 wherein said biasing means comprises a spring operatively connected between said first member and said connecting rod such that said connecting rod pulls said sensing link about the pivot point of said sensing link.

4. The linkage means of claim 1 wherein said mechanical signal originating means comprises linkage actuation means comprising:

a sensing link pivotally mounted to said first member;

a connecting rod for operatively connecting said sensing link to said first link;

a roller rotatably mounted to said sensing link;

a slide bar reciprocally mounted to said first member in a position such that said roller continuously rides thereon;

said slide bar defining two roller surfaces, said first surface shaped such that when said roller rides thereon said sensing link is operatively positioned to a first position, and said second surface shaped such that when said roller rides thereon said sensing link is operatively positioned to a second position;

biasing means for retaining said sensing link against said first and second surfaces of said slide bar; and means for operatively moving said slide bar relative to said sensing link and said roller, to enable thereby linkage actuation to occur when said slide bar is moved to the position where the sensing link is positioned in said first position.

5. The linkage means of claim 1 wherein said first link further comprises adjustment means for providing that said first link may be moved relative to said pivot axis of said first and second members to allow adjustment of the centerpoint of said circular cam surface relative to said pivot axis of said first and second members.

6. The linkage means of claim 1 wherein said mechanical receiver means comprises control actuation means comprising:

a second connecting rod operatively connected to said second link for enabling the coupling of rotative movement of said second link to said second connecting rod when said second link moves between said first and said second position; and control means actuated in response to the movement of said second connecting rod.

7. The linkage means of claim 6 wherein said second link further comprises adjustable stop means to allow the said second position of said second link to be selectively varied.

8. A construction vehicle including a work tool movably mounted to said vehicle, at least one fluid-actuating telescoping cylinder rotatably mounted to said vehicle and operatively connected to said work tool for selectively moving said work tool to various work positions on said vehicle, and including linkage means for enabling the detection of a given position of said cylinder to be coupled to control means across the pivot axis between said cylinder and said vehicle, said linkage means comprising:

a first link pivotally mounted to said cylinder to be pivotable to first and second positions relative thereto, and defining a circular cam surface;

a second link pivotally mounted to said vehicle to be pivotable to first and second positions relative thereto and defining a coacting surface which said circular cam surface contacts with the first link in said first position thereto, to define a first position of the second link;

means for moving the second link to a second position responsive to movement of the first link to its second position;

linkage actuation means operatively coupled to said first link to selectively move said first link to respective first and second positions;

control actuation means operatively coupled to said second link to be moved upon movement of said second link to said first and second positions thereof responsive to movement of said first link to said respective first and second positions thereof; and wherein the centerpoint of the circular cam surface lies substantially along the pivot axis of the said cylinder with respect to said vehicle with the first link in said first position, and with the circular cam surface in contact with said coacting surface of the second link, so that during pivoting of said cylinder relative to said vehicle with the first link in said first position, the second link remains stationary relative to said vehicle.

9. The linkage means of claim 8 wherein said linkage actuation means comprises:

a sensing link pivotally mounted to said cylinder;

a connecting rod for operatively connecting said sensing link to said first link;

a roller rotatably mounted to said sensing link;

a slide bar reciprocally mounted to said cylinder for operatively moving in response thereto, said bar being positioned such that said roller may ride thereon; and biasing means for retaining said sensing link in a first position when said roller is not riding on said slide bar, and wherein said biasing means allows said sensing link to move to a second position when said roller is rotatably riding on said slide bar.

10. The linkage means of claim 9 wherein said biasing means comprises a spring operatively connected between said cylinder and said connecting rod such that said connecting rod pulls said sensing link about the pivot point of said sensing link.

11. The linkage means of claim 8 wherein said first link further comprises adjustment means for providing that said first link may be moved relative to said pivot axis between said cylinder and said vehicle to allow adjustment of the centerpoint of said circular cam surface relative to said pivot axis.

12. The linkage means of claim 8 wherein said control actuation means comprise:

a second connecting rod operatively connected to said second link to enable the coupling of rotative movement of said second link to said second connecting rod when said second link moves between said first and said second position; and control means actuated in response to the movement of said second connecting rod.

13. The linkage means of claim 12 wherein said second link further comprises adjustable stop means to allow the said second position of said second link to be selectively varied.

* * * * *